United States Patent [19]

Burgbacher

[11] 4,116,397

[45] Sep. 26, 1978

[54] DRIVE ARRANGEMENT FOR YARN STORAGE AND DISPENSING UNITS

[75] Inventor: Martin Burgbacher, St. Georgen, Germany

[73] Assignee: Papst Motoren KG, St. Georgen, Schwarzwald, Germany

[21] Appl. No.: 716,471

[22] Filed: Aug. 20, 1976

Related U.S. Application Data

[63] Continuation of Ser. No. 530,039, Dec. 5, 1974, abandoned.

[30] Foreign Application Priority Data

Dec. 6, 1973 [DE] Fed. Rep. of Germany ..... 2360900

[51] Int. Cl.[2] ..... B65H 51/20

[52] U.S. Cl. ..... 242/47.01; 66/132 R; 139/452; 242/47.05; 242/47.12; 310/67 R

[58] Field of Search ..... 242/47.01, 47.12, 45, 242/75.51, 47.05; 310/67 R, 156, 256; 66/132 R; 139/452

[56] References Cited

U.S. PATENT DOCUMENTS

| | | | |
|---|---|---|---|
| 2,772,046 | 11/1956 | Shomphe | 310/67 R |
| 3,002,118 | 9/1961 | Papst | 310/67 R X |
| 3,273,985 | 9/1966 | Small et al. | 242/45 X |
| 3,329,845 | 7/1967 | Lear | 310/156 X |
| 3,476,330 | 11/1969 | Curtland | 242/45 |
| 3,924,818 | 12/1975 | Pfeifle | 242/47.05 |

*Primary Examiner*—Stanley N. Gilreath
*Attorney, Agent, or Firm*—Otto John Munz

[57] ABSTRACT

The arrangement includes a drive motor for driving the winding member of a yarn storage and dispensing unit. The output torque of the drive motor is substantially independent of the momentary operational speed. The drive motor either is a synchronous hysteresis motor comprising means for suppressing eddy currents, or is a DC motor the motor current of which is maintained at a constant value corresponding to the desired driving torque.

5 Claims, 4 Drawing Figures

DRIVE ARRANGEMENT FOR YARN STORAGE AND DISPENSING UNITS

BACKGROUND OF THE INVENTION

The present invention relates to a drive arrangement for a yarn storage and dispensing unit serving as a yarn buffer and delivery unit for textile machines, said arrangement comprising a rotatingly driven cylindrical winding member on which the yarn is adapted to be wound up in juxtapositioned windings and from which the yarn leaves at the axial side far from the yarn supply point to be fed to the textile machine, wherein the yarn coil is adapted to be axially shifted against the action of a frictional force so that the drive motor is braked by this frictional force in correspondence with a yarn coil of desired length.

In practice, there are frequently substantial variations of the length of yarn to be withdrawn from the yarn coil via the yarn storage and delivery unit within the unit of time; accordingly the yarn often is not withdrawn in a proper manner. According to a prior proposal the yarn windings have been pushed on the winding member by a toothed disc driven by the winding member and having an axis of rotation inclined relative to the axis of rotation of the winding member. The winding member itself is driven by a motor. This arrangement makes use of the fact that a counter force is developed between the yarn windings and the toothed disc which force, as defined above, provides for a braking torque acting on the winding member and increasing with the length of the coil, and that the amount of yarn stored on the winding member merely can increase until the braking torque reaches the driving torque of the motor.

When a driving motor is used the torque of which in the usual manner decreases with increasing motor speed the amount of yarn stored on the winding member of the yarn storage and dispensing unit will become smaller at high yarn withdrawal speeds whereas this amount increases at low yarn withdrawal speeds. Accordingly there is the risk that at very high yarn withdrawal speeds the yarn storage and dispensing unit can no longer fulfill its intented buffer function whereas at low withdrawal speeds excessive yarn is wound up and two or more yarn layers are superimposed thereby preventing a uniform, smooth yarn supply to the textile machine.

Therefore it has been proposed to drive the winding member of such a yarn storage and dispensing unit by a motor providing for a torque which is substantially constant within the range of the operational speeds. However, it turned out to be difficult to obtain the desired constancy of the motor torque.

SUMMARY OF THE INVENTION

It is a general object of the invention to provide a drive arrangement for a yarn storage and dispensing unit having a torque characteristic such that the torque delivered by the electric drive motor is, within the range of the operational speeds, substantially independent of the momentary speed, without an additional electronic control circuit or other expensive units being required.

This object, and others which will become more understandable from the description, below, of two exemplary embodiments, can be met, according to one advantageous concept of the invention, by providing a drive arrangement comprising a synchronous hysteresis motor the synchronous speed of which is equal to or higher than the maximum speed expected to occur during operation, said synchronous hysteresis motor including means for suppressing eddy currents.

The torque characteristic of the ideal hysteresis motor runs horizontally up to the synchronous speed and at this speed drops to zero. However, in practice the torque characteristic of common hysteresis motors more or less differs from the characteristic curve of the ideal hysteresis motor. It has been found that this is due to eddy current effects which cause the torque to increase with increasing speed of rotation up to an asynchronous pull-out torque whereupon the torque gradually decreases with the range between the speed corresponding to the pull-out torque and the synchronous speed. In order to prevent such deviations from the ideal characteristic of the hysteresis motor from influencing the length of the yarn coil wound up on the winding member of the yarn storage and dispensing unit the synchronous hysteresis motor used according to the invention for driving the storage and dispensing unit is provided with means for suppressing eddy currents. Thereby the characteristic curve of the ideal hysteresis motor may be well approximated.

According to an advantageous concept of the invention the driving motor comprises a hysteresis ring the axial width of which is restricted to the axial length of the laminated stator core of the motor thereby reducing the eddy currents irrespective of the grade of the material of the hysteresis ring.

According to another advantageous concept of the invention the wall thickness of the hysteresis ring is minimized. This likewise reduces eddy currents because the cross-section of the eddy current path will become smaller. Furthermore the ratio between alternating hysteresis and rotational hysteresis is increased because the flux is forced to follow a substantially tangential path within the hysteretic layer whereby a stronger magnetization in circumferential direction is obtained when compared with a hysteretic layer of larger radial thickness. The increase of the share of the alternating hysteresis furthermore constitutes an increase of the hysteretic torque.

In practice there is an upper limit for the tolerable costs and/or for the magnetic quality of the hysteretic material. Furthermore with a selected grade of material a predetermined volume of material is required to obtain a certain synchronous torque output. Therefore the diameter of the hysteresis ring preferably is made relatively larger in order to provide at a predetermined volume of the hysteretic material for a hysteresis ring of small radial dimension. This specifically applies when a relatively inexpensive material of limited magnetic quality is used.

According to another concept of the invention the drive motor used is of the external rotor type. This aids in providing for a large diameter, radially thin-walled hysteresis ring of sufficient volume. In case the hysteretic material is of relatively low magnetic quality and accordingly is inexpensive and therefore economically attractive, the specific resistance thereof is comparatively low. Under these circumstances measures for suppressing eddy currents are of specific importance. Hence, it is contemplated according to the invention to provide for a motor of the external rotor type having a relatively large air gap diameter whereby the alternating flux portion is comparatively increased. Thus by limiting the axial dimension of the hysteresis ring to the axial height of the laminated stator core, by using a motor of the external rotor type having a relatively large air gap diameter, and by reducing the radial wall thickness of the hysteresis ring to the magnitude required to obtain the volume necessary for the desired synchronous power output, an inexpensive drive arrangement having a properly constant torque characteristic is provided for.

Eddy current suppression likewise may be effected by using a hysteretic material of high magnetic quality. Such a material has a high specific resistance. In view of the high magnetic quality the volume of material required for a predetermined synchronous power output is comparatively small. Therefore the radial thickness of the hysteresis ring may be further decreased. However, the costs of such a high grade material are substantial.

According to another concept of the invention a constant, speed-independent torque characteristic of the drive arrangement is obtained by using a DC-motor, preferably a collector-less DC-motor, the motor current of which is maintained at a constant value corresponding to the desired driving torque. In such a case the motor current preferably is controlled by an electronic control unit.

A specifically simple and compact design may be obtained by using a drive motor of the external rotor type, the rotor of which constitutes the winding member.

In order to prevent the torque characteristic of the drive arrangement from being undesirably influenced by frictional loss, preferably care is taken to minimize the bearing friction load. In specific applications in which the frictional loss remarkably increases with increasing speed of rotation it may be advantageous to provide for a motor torque which increases at higher speeds in conformity with the frictional loss increase, e.g. by superimposing an asynchronous torque which increases up to the pull-out speed. Furthermore a low-inertia rotor or winding member is advantageous with regard to the nonsteady operational conditions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
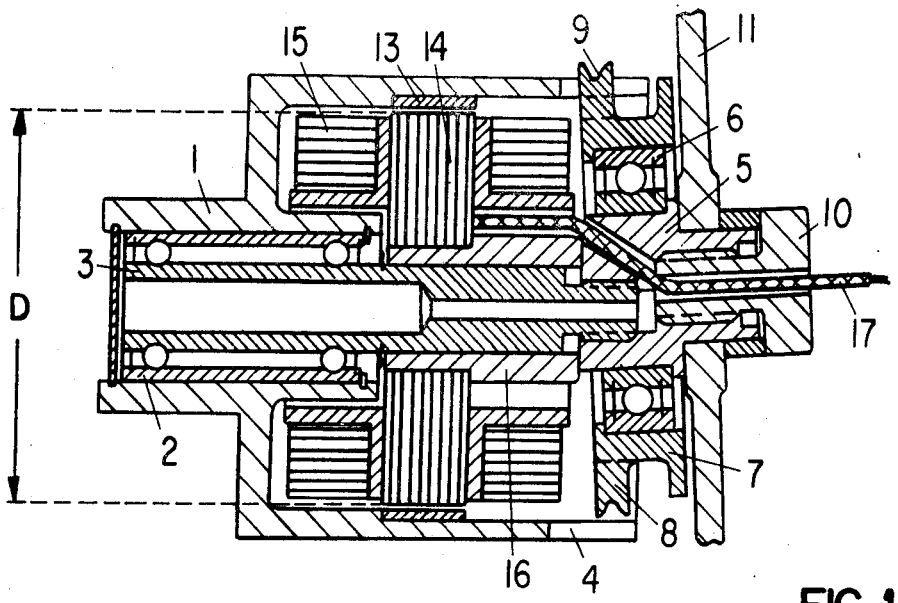
FIG. 1 is a longitudinal sectional view through a yarn storage and dispensing unit comprising a drive arrangement according to the invention.

The yarn storage and dispensing unit illustrated in FIG. 1 comprises a cylindrical winding member 1 rotatably mounted by bearing means 2 on a fixed shaft 3. The winding member 1 at its in FIG. 1 righthand face is provided with a set of teeth 4. A mounting body 5 is screwed onto the end of shaft 3 facing the teeth 4. The longitudinal axis of mounting body 5 is inclined with respect to the axis of shaft 3. A toothed disc 7 is mounted by a ball bearing 6 for rotation about mounting body 5. The teeth 8 of disc 7 are in meshing engagement with the teeth 4 of winding member 1. Toothed disc 7 has a peripheral annular groove 9. The section of the axis of mounting body 5 and of the central plane of annular groove 9 normal to the axis of mounting body 5 is positioned eccentrically with respect to the motor axis. By means of a fastening screw 10 extending into the mounting body 5 the yarn storage and dispensing unit is attached to mounting means 11.

The yarn coming from a yarn spool (not shown) goes into the annular groove 9 of disc 7. From annular groove 9 the yarn proceeds to the periphery of winding member 1, wherein juxtapositioned yarn windings are pushed by toothed disc 7 onto the cylindrical outside surface of winding member 1. The yarn continues to travel to a textile machine (not shown) from the side of the yarn coil on winding member 1 far from toothed disc 7.

Yarn storage and dispensing units of the type described above are known and e.g. have been disclosed in more detail in German Offenlegungsschrift No. 2,350,979. The disclosure of this publication is hereby incorporated by reference.

Winding member 1 constitutes the rotor of the drive motor and at its inner wall carries a steel ring 13 having permanent magnetic or hysteretic characteristics; in the present disclosure this ring will be shortly called "hysteresis ring". Hysteresis ring 13 rotates about the laminated stator core 14 which carries the motor coil 15. The laminated stator core 14 on its part is positioned on a mounting sleeve 16 surrounding the stationary shaft 3. The power lead of motor coil 15 is indicated at 17.

Figure 2:
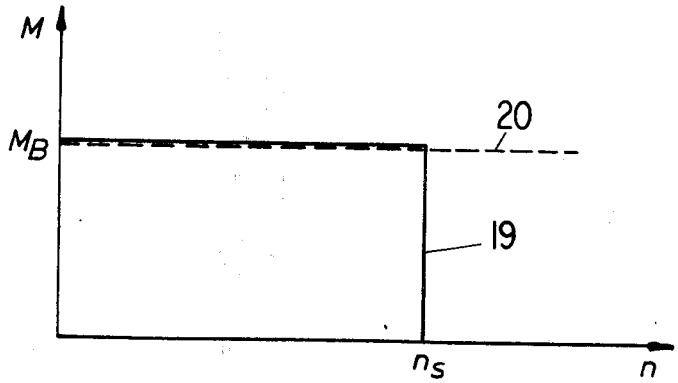
FIG. 2 depicts in full lines the torque characteristic of the drive motor of the yarn storage and dispensing unit of FIG. 1 and in broken line the torque characteristic of a modified drive motor.

The drive motor comprising the winding member 1, the hysteresis ring 13, the laminated stator core 14 and the motor coil 15 constitutes a hysteresis synchronous motor of the external rotor type, the torque characteristic 19 of which is illustrated in FIG. 2 in full lines. Up to the synchronous speed $n_s$ which is higher than the expected maximum speed of the yarn storage and dispensing unit the torque is of a substantially constant magnitude $M_B$. At the synchronous speed the torque becomes zero. In order to obtain or at least to closely approximate this characteristic the axial length of hysteresis ring 13 is made equal to the axial length of laminated stator core 14. Furthermore the hysteresis ring 13 and the stator sheets 14 are axially aligned. This prevents the hysteresis ring 13 from extending in axial direction beyond the laminated stator core 14, which extension would favour the return of eddy currents. Furthermore the hysteresis ring 13 in radial direction is made as thin as possible with respect to a full modulation of the hysteretic material and to a predetermined hysteretic torque. Thereby the formation of eddy current conductive paths is counteracted.

The radial thickness of the hysteresis ring 13 preferably amounts to between about 2 and 3 mm. If this thickness is smaller than 2 mm machining in mass production will become problematic; the material required in such a case will be substantially more expensive especially if the radial thickness is less than about 1.5 mm.

The air gap between the stator core 14 and the hysteresis ring 13 is cylindrical in form because it is located within the hysteresis ring. The diameter D of the cylindrical air gap is about 65 mm in the preferred embodiment. In any event, it is preferable that the ratio between the radial thickness of the hysteresis ring and the diameter D of the air gap be, at most, a ratio of 1 to 15. If the thickness of the hysteresis ring is 3 mm and the diameter of the air gap is 65 mm, that ratio is about 1 to 22.

If during operation yarn windings are formed and are pushed onto the periphery of winding member 1 from the righthand side (in FIG. 1) thereof the length of the single-layer coil defined by these windings will increase if the length of yarn withdrawn at this moment from the lefthand side (in FIG. 1) of the coil is smaller than the length of yarn wound on winding member 1. The braking torque applied to the drive motor increases with increasing length of the coil. The motor will be stopped when the braking torque reaches the torque delivered by the motor. When yarn now again is withdrawn from winding member 1 the braking torque is decreased. The drive motor is accelerated until the peripheral speed of winding member 1 equals the yarn withdrawal speed.

Because of the torque characteristic 19 shown in FIG. 2 the length of the yarn coil on winding member 1 will be maintained substantially constant irrespective of the momentary magnitude of the yarn withdrawal speed.

Figure 3:
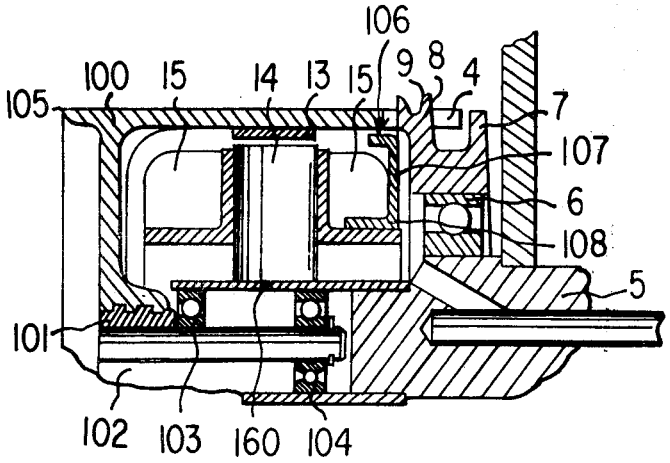
FIG. 3 is a partial longitudinal sectional view through a further embodiment of the invention comprising a low-inertia compact rotor and low-bearing friction mounting means.

FIG. 3 discloses an embodiment of a drive motor of the external rotor type in which particularly the rotor has been modified. The hysteresis ring 13 in a manner similar to FIG. 1 is inserted into a thin-walled bell-shaped winding member 100 made of light metal such as aluminum, magnesium or alloys thereof, member 100 accordingly having low inertia. A coaxially arranged rotor shaft 102 is connected to winding member 100 for common rotation therewith by bushing 101 cast in member 100. Rotor shaft 102 is rotatably mounted in ball bearings 103 and 104 which are positioned within a hollow shaft or sleeve 160 fixed to mounting body 5 and carrying the laminated stator core 14. Ball bearings 103 and 104 provide for minimum friction and noise. The embodiment of FIG. 3 particularly saves space in the axial direction. Winding member 100 comprises a protruding rim 105 the axial length of which is determined by the required maximum length of the yarn coil formed on winding member 100.

The outer periphery of a cover disc 107 the outer diameter of which is merely slightly smaller than the outer diameter of hysteresis ring 13 is positioned axially closer to the bottom of the bell-shaped rotor 100 than the bottom surfaces 106 of the teeth 4 at the open end of the rotor bell. Cover disc 107 has an inner flange 108 engaging the sleeve 160 and provides for a protection against electric shock hazard.

The broken line 20 shown in FIG. 2 illustrates the torque characteristic of a DC motor the current supplied to which is maintained at a constant value corresponding to the desired driving torque $M_B$. DC motors having a controlled motor current are known per se and therefore need not be described and illustrated in detail; however, an example of a collectorless DC-motor drive arrangement for a yarn storage and dispensing unit in accordance with the invention is shown in FIG. 4, it being appreciated that any constant current DC motor having a constant, speed-independent torque characteristic could be used.

Figure 4:
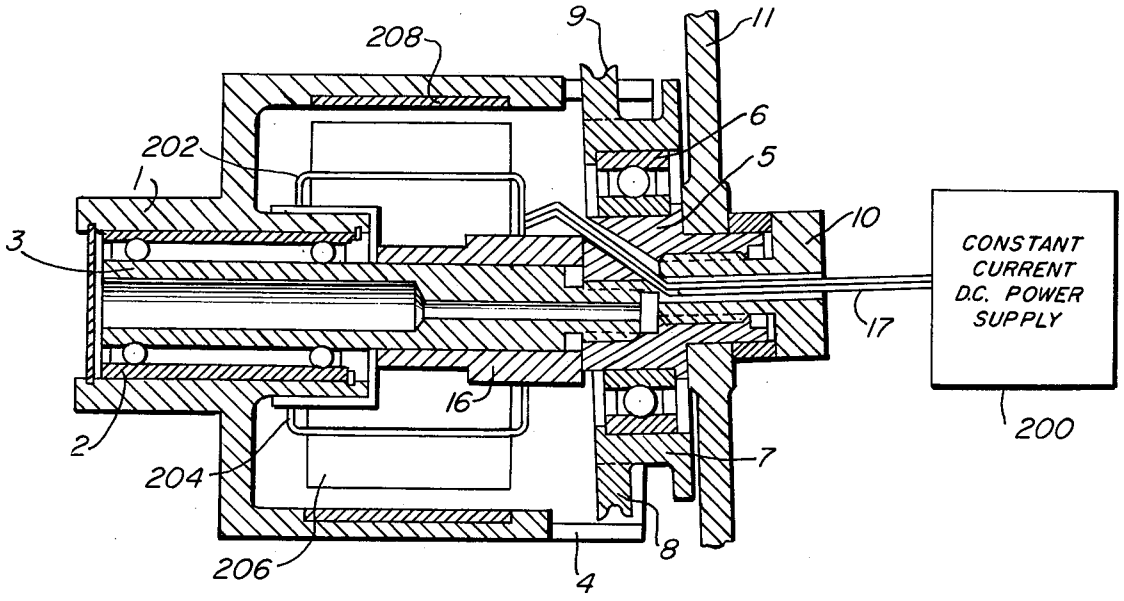
FIG. 4 is a longitudinal sectional view through another embodiment of the invention using a collectorless DC-motor.

Parts of the embodiment of FIG. 4 identical to parts of the embodiment of FIG. 1 are given identical reference numbers and are not described again for the sake of brevity. A constant current DC power supply 200 supplies electricity via leads 17 to winding halves 202 and 204 wound on a stator 206 which is positioned on mounting sleeve 16. A center tap between the winding halves is also connected to supply 200 via leads 17, and the supply 200 includes suitable switching circuitry to alternately supply current to the winding halves. The external rotor of the DC motor includes a permanent magnet 208 carried by the winding member 1 in alignment with the stator 206. While any constant torque external rotor DC motor could be used with the present invention, a detailed description of one example of a DC motor suitable for use with the present invention can be found in U.S. Pat. No. 3,873,897 to Muller, the disclosure of such patent being incorporated herein by reference.

While specific embodiments of the invention have been illustrated and described, the invention is not intended to be limited to the details shown, since various modifications and structural changes may be made without deporting in any way from the spirit of the present invention.

What is claimed as new and desired to be protected by Letters Patent is set forth in the appended claims:

1. A drive arrangement for a yarn storage and dispensing unit of the type having a cylindrical winding member rotatably mounted to take up yarn at a yarn supply point and axially shift the yarn in juxtaposed windings along said winding member to a yarn delivery point from which the yarn can be fed to a textile machine, said drive arrangement comprising a synchronous hysteresis drive motor including stator means centrally disposed within said winding member on a fixed shaft and including a laminated core and a motor coil;

external rotor means rotatably mounted on said shaft including said winding member, said winding member being thin-walled and constructed of a light, nonmagnetic metal; and a hysteresis ring constructed of magnetically low-grade carbon steel carried by said winding member in axial alignment with said stator core, said hysteresis ring having an axial length no greater than the axial length of said stator core and having a minimum radial thickness with respect to full modulation of said carbon steel to suppress eddy currents, said drive motor being braked by friction from movement of yarn windings along said winding member to operate at speeds less than the synchronous speed of said drive motor to drive said winding member with a substantially constant torque.

2. A drive arrangement for a yarn storage and dispensing unit as recited in claim 1 wherein said fixed shaft is hollow, said rotor means includes a rotor shaft carried by said winding member and rotatably supported in said hollow fixed shaft and said winding member has a closed end carrying said rotor shaft, an open end and a rim protruding axially from said closed end, and further comprising a cover disc mounted on said fixed shaft at said open end of said winding member and having a diameter slightly less than the diameter of said hysteresis ring.

3. A drive arrangement for a yarn storage and dispensing unit as recited in claim 2 wherein said drive motor has an air gap and the ratio of the radial thickness of said hysteresis ring to said air gap is less than one to fifteen.

4. A drive arrangement for a yarn storage and dispensing unit as recited in claim 3 wherein said air gap is about 65 mm and said radial thickness of said hysteresis ring is between 2 and 3 mm.

5. A drive arrangement for a yarn storage and dispensing unit of the type having a cylindrical winding member rotatably mounted to take up yarn at a yarn supply point and axially shift the yarn in juxtaposed windings along said winding member to a yarn delivery point from which the yarn can be fed to a textile machine, said drive arrangement comprising a collectorless DC drive motor including stator means carrying winding means defining poles, rotor means including permanent magnet means carried by said winding member, and means for supplying a constant current to said winding means corresponding to a desired driving torque, said drive motor being braked by friction from movement of yarn windings along said winding member while rotating said winding member with a substantially constant torque.

* * * * *